US006683284B2

(12) United States Patent
Nyman et al.

(10) Patent No.: US 6,683,284 B2
(45) Date of Patent: Jan. 27, 2004

(54) THERMAL ROLL FOR PAPERMAKING WITH A FLUID CIRCULATION SYSTEM AND METHOD THEREFOR

(75) Inventors: Gustaf Per-Arne Nyman, Karlstad (SE); Johnny Ånerud, Karlstad (SE)

(73) Assignee: Metso Paper Karlstad AB, Karlstad (SE)

( * ) Notice: Subject to any disclaimer, the term of this patent is extended or adjusted under 35 U.S.C. 154(b) by 92 days.

(21) Appl. No.: 10/104,265

(22) Filed: Mar. 22, 2002

(65) Prior Publication Data

US 2003/0178406 A1 Sep. 25, 2003

(51) Int. Cl.[7] ..... F28D 11/02; F28F 5/02; D21F 5/02

(52) U.S. Cl. ..... 219/469; 165/89; 492/46

(58) Field of Search ..... 219/244, 469; 165/89; 34/119; 492/46

(56) References Cited

U.S. PATENT DOCUMENTS

| | | | | |
|---|---|---|---|---|
| 3,601,902 A | * | 8/1971 | Schiel | 165/89 |
| 4,252,184 A | | 2/1981 | Appel | |
| 4,639,990 A | * | 2/1987 | Schiel et al. | 492/46 |
| 4,679,287 A | | 7/1987 | Allard | |
| 4,683,628 A | | 8/1987 | Schönemann | |
| 4,717,338 A | | 1/1988 | Cellier | |
| 4,757,582 A | | 7/1988 | Verkasalo | |
| 4,781,795 A | | 11/1988 | Miller | |
| 4,955,268 A | | 9/1990 | Ickinger et al. | |
| 4,964,202 A | | 10/1990 | Pav et al. | |
| 5,383,833 A | * | 1/1995 | Brugger et al. | 492/46 |
| 5,404,936 A | | 4/1995 | Niskanen et al. | |
| 5,549,154 A | | 8/1996 | Niskanen et al. | |
| 5,839,203 A | | 11/1998 | Orloff et al. | |
| 6,161,302 A | | 12/2000 | Rantala | |
| 6,250,376 B1 | | 6/2001 | Hendrix | |
| 6,309,512 B1 | | 10/2001 | Bengtsson et al. | |

FOREIGN PATENT DOCUMENTS

| | | |
|---|---|---|
| DE | 33 33 734 A1 | 2/1984 |
| DE | 198 03 792 A1 | 6/1999 |
| DE | 198 14 597 C1 | 10/1999 |
| WO | WO 00/45104 | 8/2000 |
| WO | WO 00/58554 | 10/2000 |
| WO | WO 02/095249 A1 | 5/2002 |

* cited by examiner

*Primary Examiner*—Joseph Pelham
(74) *Attorney, Agent, or Firm*—Alston & Bird LLP

(57) ABSTRACT

A thermal roll for efficiently transferring heat to or from a web is provided. The thermal roll includes a rotatable outer shell having a cylindrical outer mantle and a stationary inner shell within the rotatable outer shell. An annular space is defined between an inner surface of the rotatable outer shell and an outer surface of the stationary inner shell. The annular space of a relatively low volume is filled with a heat exchange fluid, such as oil or water, that exchanges heat with a fibrous web through the mantle of the rotatable outer shell. The low volume of the annular space enables high heat transfer rates to the web and quick and efficient changes to the temperature of the heat exchange fluid. The thermal roll is adaptable for use as various types of rolls, such as calender rolls, press rolls, drying cylinders, and Yankee cylinders.

37 Claims, 12 Drawing Sheets

THERMAL ROLL FOR PAPERMAKING WITH A FLUID CIRCULATION SYSTEM AND METHOD THEREFOR

FIELD OF THE INVENTION

The invention relates to rolls used in processing or manufacturing paper or other web-like materials, and specifically to a thermal roll used for heating or cooling a paper or other web. In particular, the roll is useful for impulse drying a paper web.

BACKGROUND OF THE INVENTION

Various types of rolls are used during the manufacture and processing of paper and other web-like materials. For example, paper machines may include calender rolls, press rolls, drying cylinders, and Yankee cylinders. Each of these rolls performs some type of processing on the web. For example, a web may be heated or cooled.

One example of an apparatus used for heating the web is an impulse dryer, which rapidly supplies a large amount of heat to dry a fibrous web. An impulse dryer can include a roll having a cylindrical shell that is rotatably journaled at its axial ends and a stationary shaft located within the shell. It is known in the prior art to heat a roll by supplying a heated liquid such as oil or water within the space defined by the shell. For example, heated water can be supplied to one end of the shell of a roll and removed from the opposite end of the shell. Heat is transferred from the water through the shell and to the web.

A number of problems are presented by such a system. First, because the heated liquid cools as it flows through the shell, it has less capacity for heating the shell near the end through which it exits. This causes non-uniformities in heating across the length of the shell. Additionally, due to the large size of rolls, large volumes of liquid can be accommodated. However, the liquid is heavy, necessitating additional energy to rotate the shell. Energy is required to heat the volume of liquid, and changes in temperature may be achieved slowly. Also, a large volume of moving liquid can interfere with the movement of the shell. Alternatively, the shell may be only partially filled with liquid, and the remaining volume filled with air. The air is pressurized in order to force the liquid from the shell. However, the pressure creates additional stress on the components of the roll and presents a danger to both nearby workers and equipment. Heating is less effective because the air in the shell is a poorer heat transfer agent than the liquid. Also, in a partially filled shell, gravity causes the heating liquid to collect at the bottom of the shell, tending to reduce the effectiveness of heating at the top of the shell.

Thus, there exists a need for a roll for transferring heat to or from a web. The roll should allow for effective and efficient heating by enabling high heat transfer rates to the web and minimizing heat losses to the working environment. Heat transfer should be uniform across the length of the roll. The roll should allow quick and efficient changes to the temperature of the heating liquid. Also, dangers associated with complex pressurized systems should be minimized. Finally, the roll should be adaptable for use as different types of rolls, such as calender rolls, press rolls, drying cylinders, and Yankee cylinders.

SUMMARY OF THE INVENTION

The present invention provides an improved thermal roll for heating or cooling a web that solves these deficiencies in the prior art. The thermal roll includes a reduced volume of heat exchange fluid, which completely fills an annular space adjacent to a rotatable outer shell that supports the fibrous web. The heat exchange fluid is passed to the annular space through a plurality of connection pipes that are fed from a main supply pipe. As a result of the heat exchange fluid filling the annular space, heat is effectively exchanged to or from the fibrous web through the rotatable outer shell.

The roll of the present invention includes a rotatable outer shell and a stationary inner shell within the outer shell. The rotatable outer shell has an outer surface and an inner surface and extends from a first head to a second head. The rotatable outer shell is positioned to rotate about a longitudinal axis and support the web. The stationary inner shell also has an outer surface and an inner surface. The outer surface of the stationary inner shell and the inner surface of the rotatable outer shell define an annular space. The stationary inner shell extends from a first end to a second end and defines a plurality of inner shell openings. The thermal roll includes a main supply pipe that is positioned within the stationary inner shell and extends from the first end of the stationary inner shell longitudinally toward the second end of the stationary inner shell. Additionally, the thermal roll includes a plurality of connection pipes that connect the main supply pipe to the plurality of inner shell openings. The annular space is completely filled with the heat exchange fluid and heat is effectively exchanged by the roll through the rotatable outer shell.

According to one embodiment of the present invention, the main supply pipe extends from the first head of the rotatable outer shell longitudinally to the second head of the rotatable outer shell. The main supply pipe has an inlet located at one of the first or second heads of the rotatable outer shell, and the main supply pipe has an outlet located at the other of the first or second heads of the rotatable outer shell. In another embodiment, the main supply pipe has an inlet and an outlet, and both the inlet and the outlet of the main supply pipe are located at the same one of either the first or second heads of the rotatable outer shell. In another embodiment of the present invention, the main supply pipe is directly connected to each of the connection pipes.

The annular space encompasses a perimeter of the outer surface of the inner shell. In one embodiment, the inner surface of the outer shell is located less than 40 millimeters from the outer surface of the inner shell. The annular space may extend from the first end of the stationary inner shell to the second end of the stationary inner shell.

According to another embodiment, the connection pipes comprise flexible hose, and the stationary inner shell defines an inner body space encompassing the connection pipes.

The thermal roll also includes a main evacuation pipe. The main evacuation pipe is positioned within the stationary inner shell and extends from the first end of the stationary inner shell longitudinally in a direction toward the second end of the stationary inner shell. The thermal roll can further include a plurality of evacuation connection pipes. The inner shell includes a second plurality of inner shell openings, and the evacuation connection pipes connect the main evacuation pipe to the second plurality of inner shell openings.

The thermal roll according to one embodiment also includes an expansion tank that is fluidly connected to the annular space. The expansion tank contains quantities of both the heat exchange fluid and a compressed gas.

The thermal roll also includes a temperature regulating device for changing the temperature of the heat exchange fluid. The temperature regulating device can be externally located or within both the outer shell and the stationary inner shell.

The present invention also provides a closed circulation system for thermally treating a web during papermaking. The circulation system, which is capable of being fluidly closed, includes an annular space defined by an inner surface of a rotatable outer shell and an outer surface of a stationary inner shell. A main supply pipe is positioned within the stationary inner shell and fluidly connected to the annular space via a plurality of connection pipes. An expansion tank, located outside the rotatable outer shell, is fluidly connected to the annular space and capable of containing quantities of both the heat exchange fluid and a compressed gas for adjustment of a flow of a heat exchange fluid within the circulation system.

Additionally, the present invention provides a method of heating or cooling a roll for processing a web. The method includes providing a rotatable outer shell and a stationary inner shell located within the rotatable outer shell to define an annular space between an inner surface of the rotatable outer shell and an outer surface of the stationary inner shell. The method also includes completely filling the annular space with a heat exchange fluid and sealing the annular space so that there is no air contained within it. The rotatable outer shell is rotated relative to the stationary inner shell to provide circulation of the heat exchange fluid from a main supply pipe through a plurality of connection pipes directly and simultaneously to a plurality of locations on the inner surface of the rotatable outer shell within the annular space. The heat exchange fluid is evacuated from the annular space to a temperature regulation device where it is heated or cooled. The heat exchange fluid is then re-circulated to the annular space.

Thus, the present invention provides a roll for efficiently transferring heat to or from a web. The roll includes an annular gap that is completely filled with a relatively low volume of heat exchange fluid, thus enabling high heat transfer rates to the web. The low volume also allows the temperature of the heat exchange fluid to be changed quickly and efficiently. Dangers associated with complex pressurized systems are minimized and heat transfer across the length of the roll can be uniform. Additionally, the roll of the present invention is adaptable for use as various types of rolls, such as calender rolls, press rolls, drying cylinders, and Yankee cylinders.

BRIEF DESCRIPTION OF THE DRAWINGS

Figure 1:
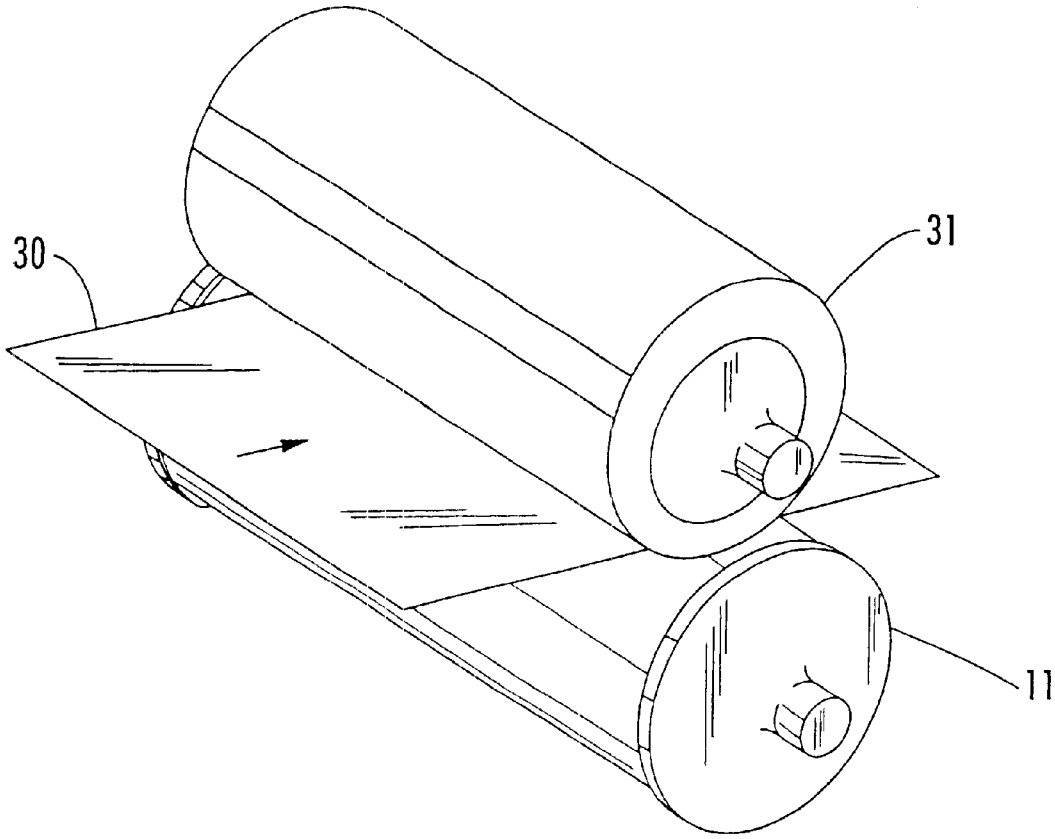
Figure 2:
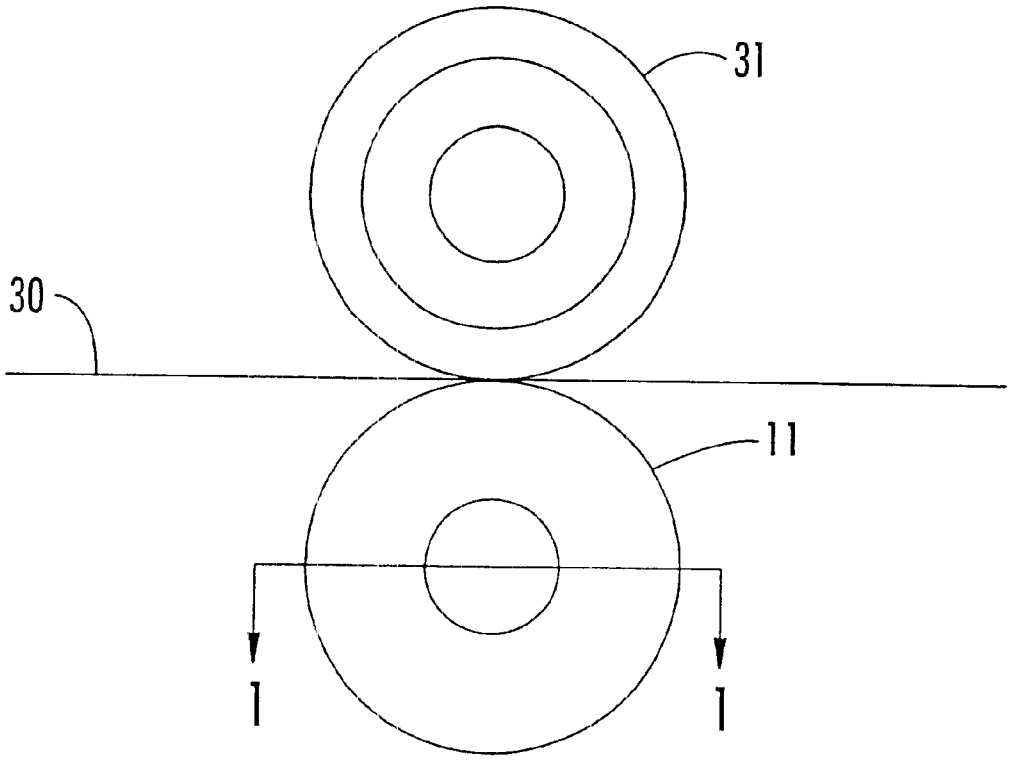
Figure 3:
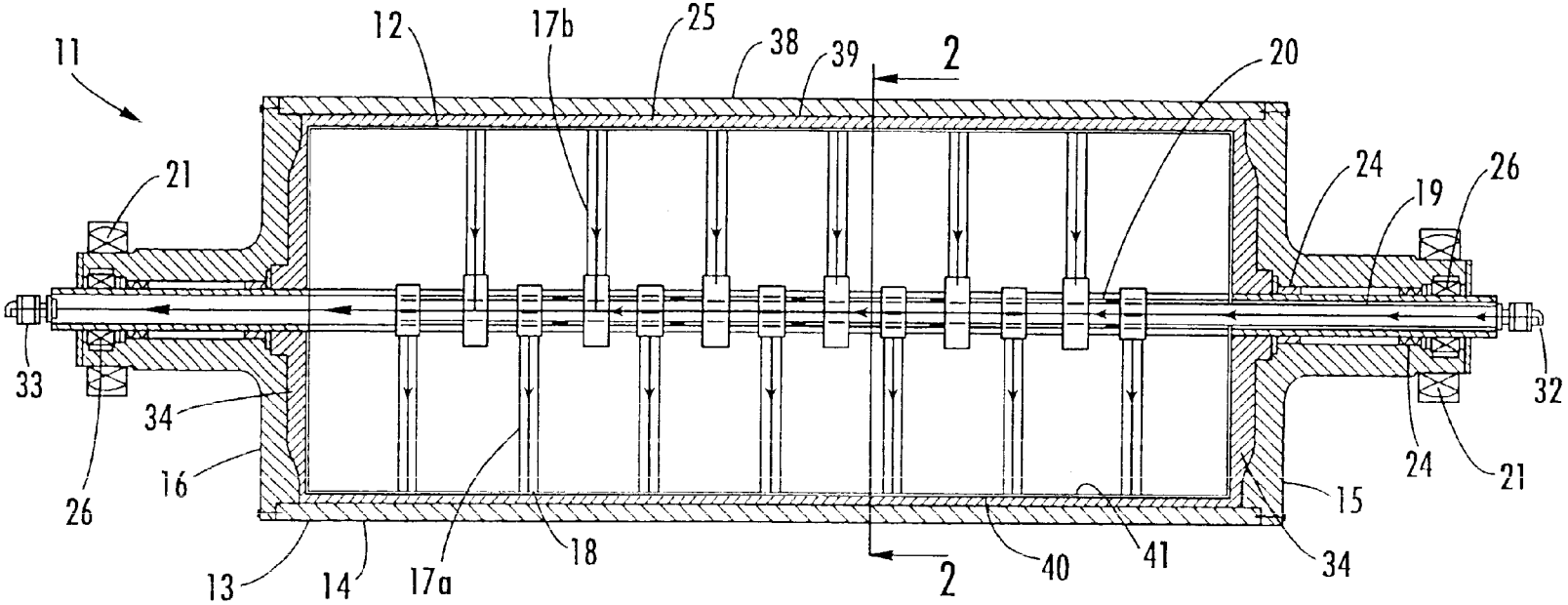
Figure 4:
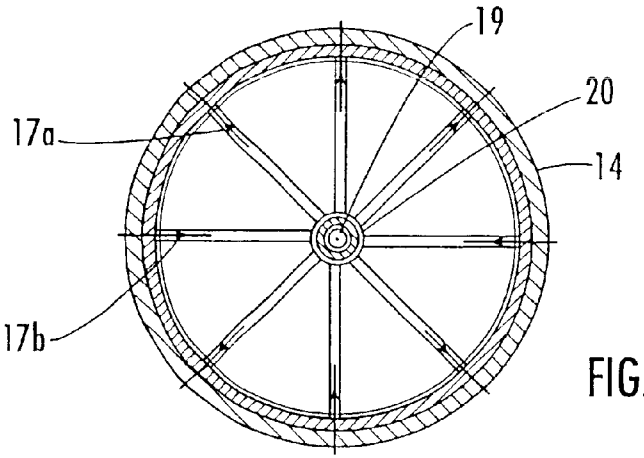
Figure 5:
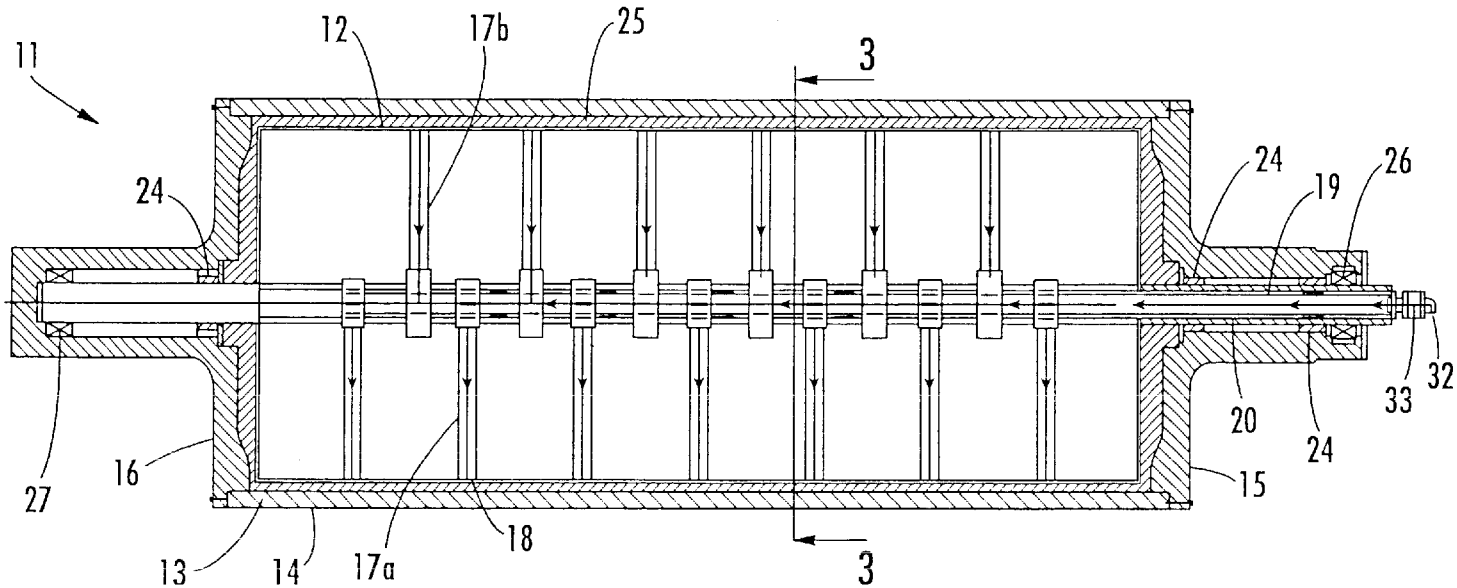
Figure 6:
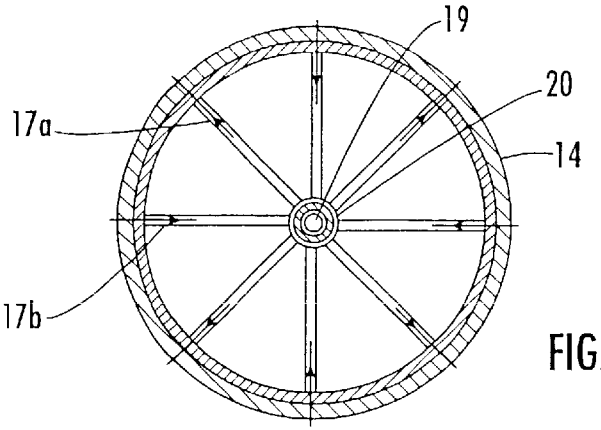
Figure 7:
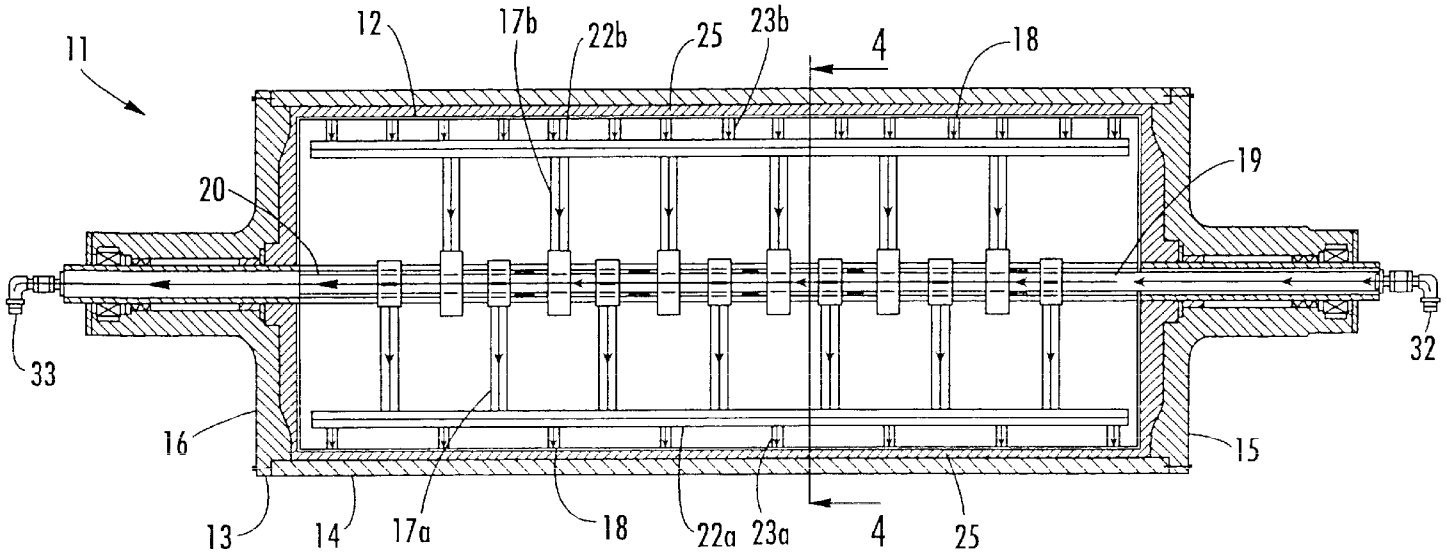
Figure 8:
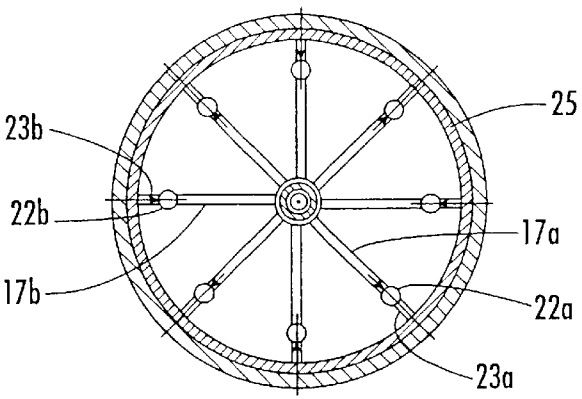
Figure 9:
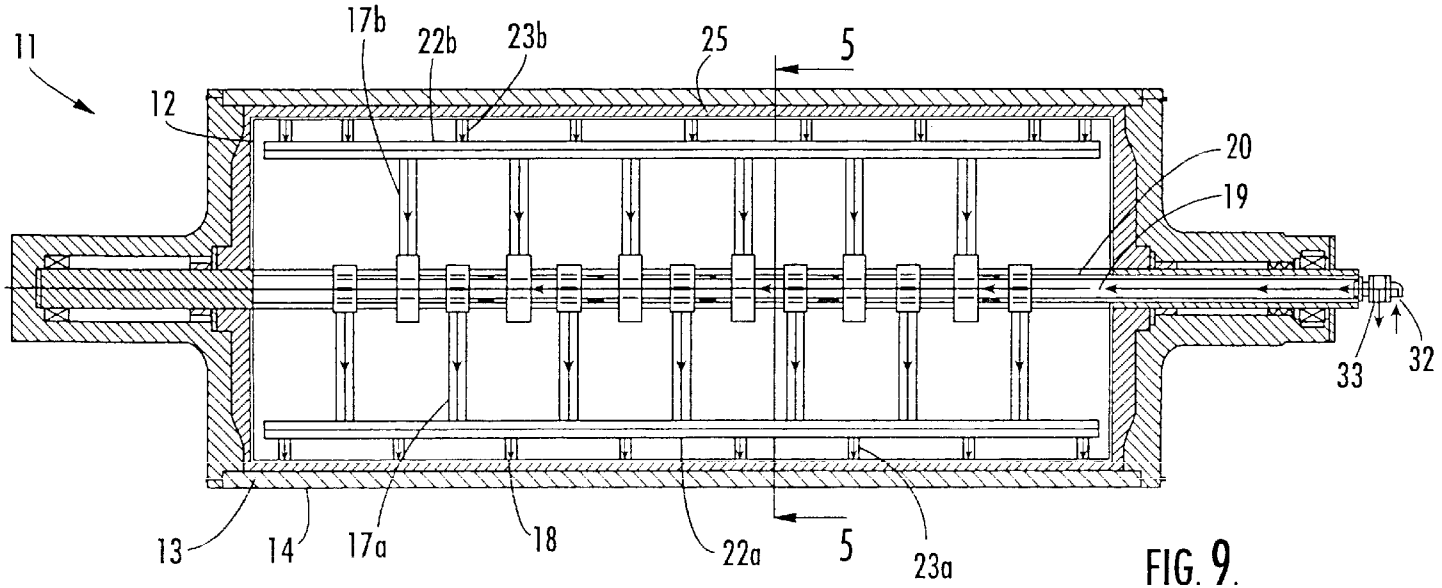
Figure 10:
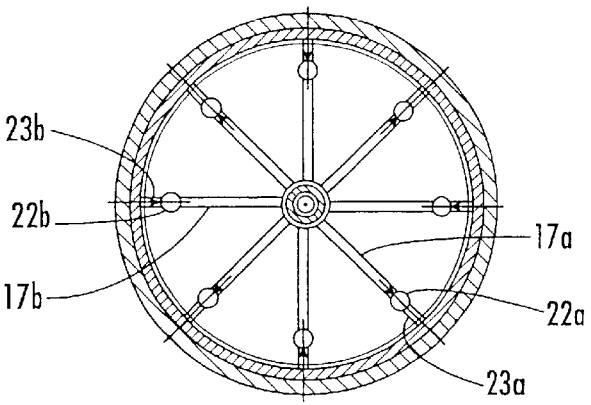
Figure 11:
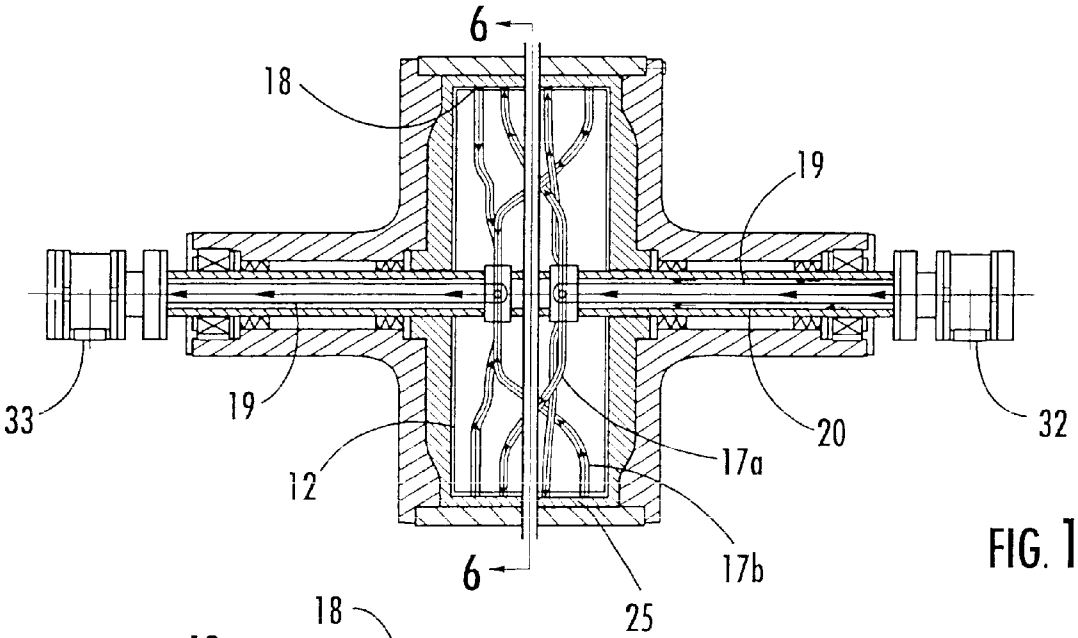
Figure 12:
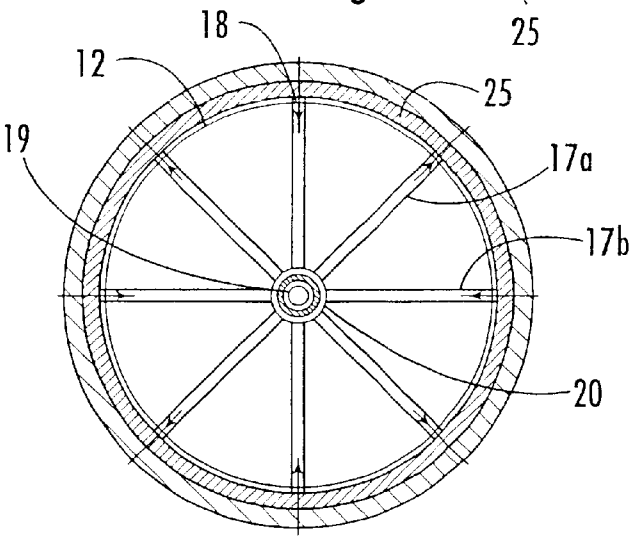
Figure 13:
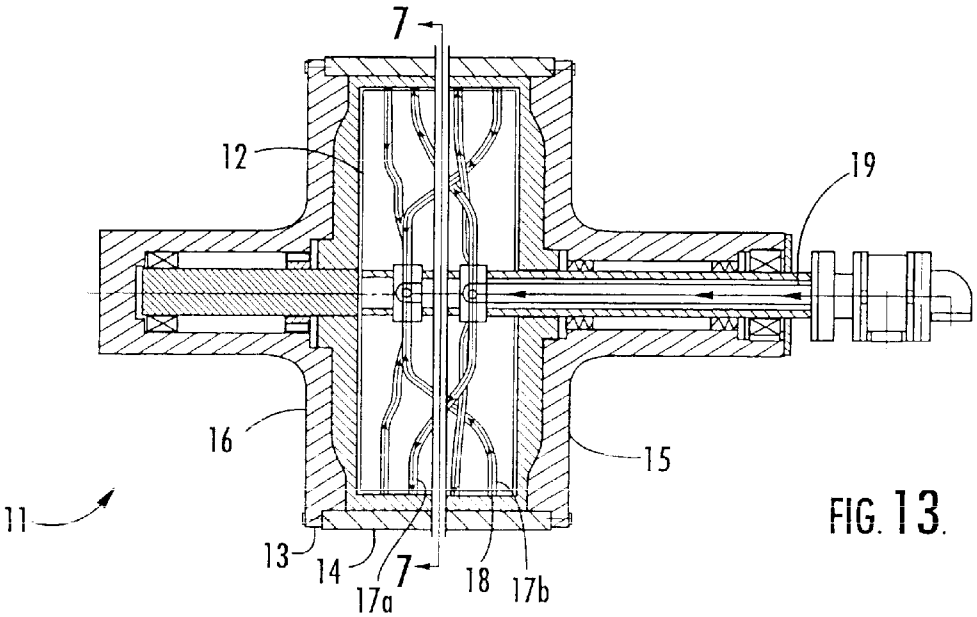
Figure 14:
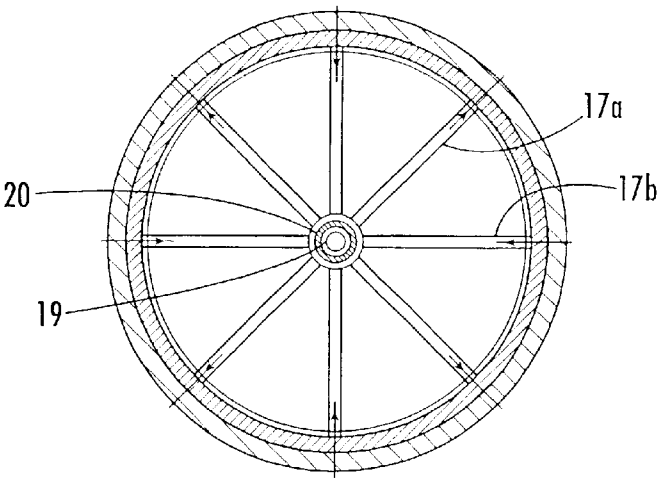
Figure 15:
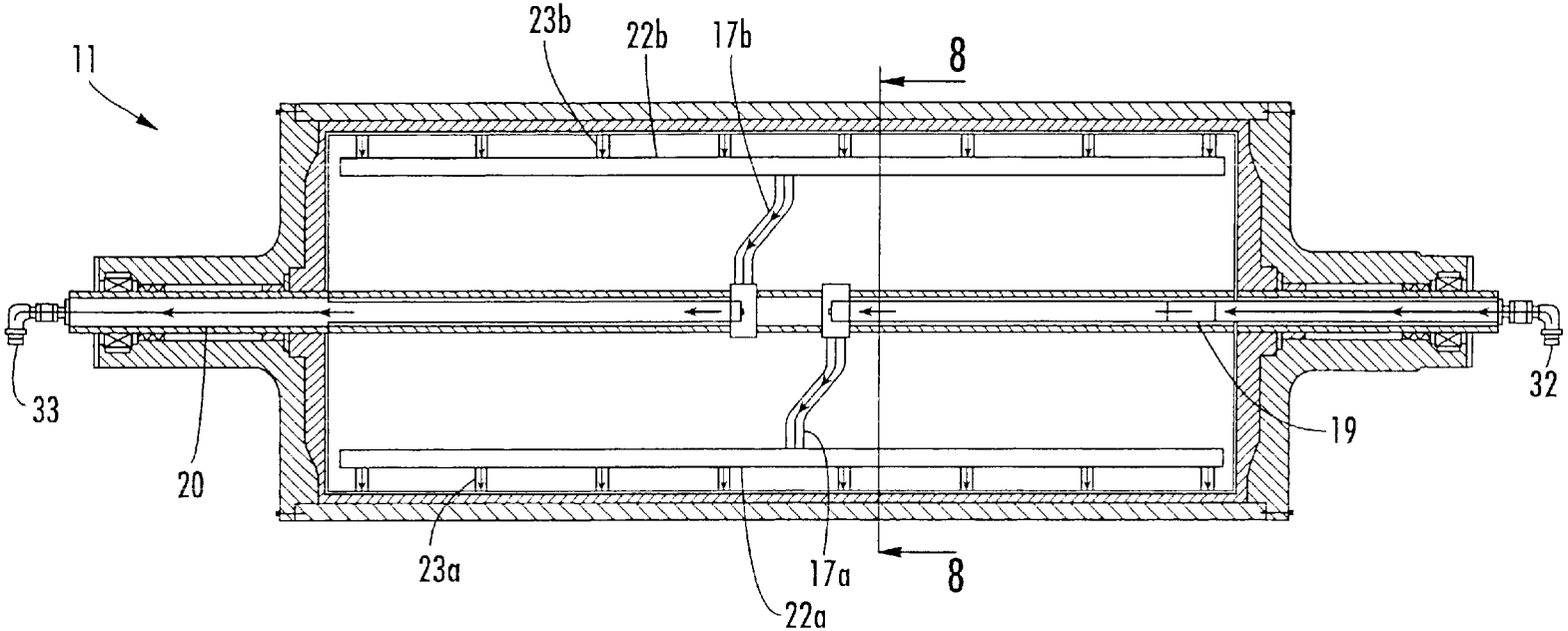
Figure 16:
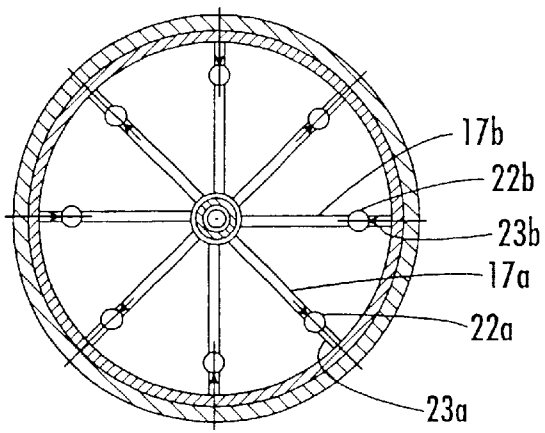
Figure 17:
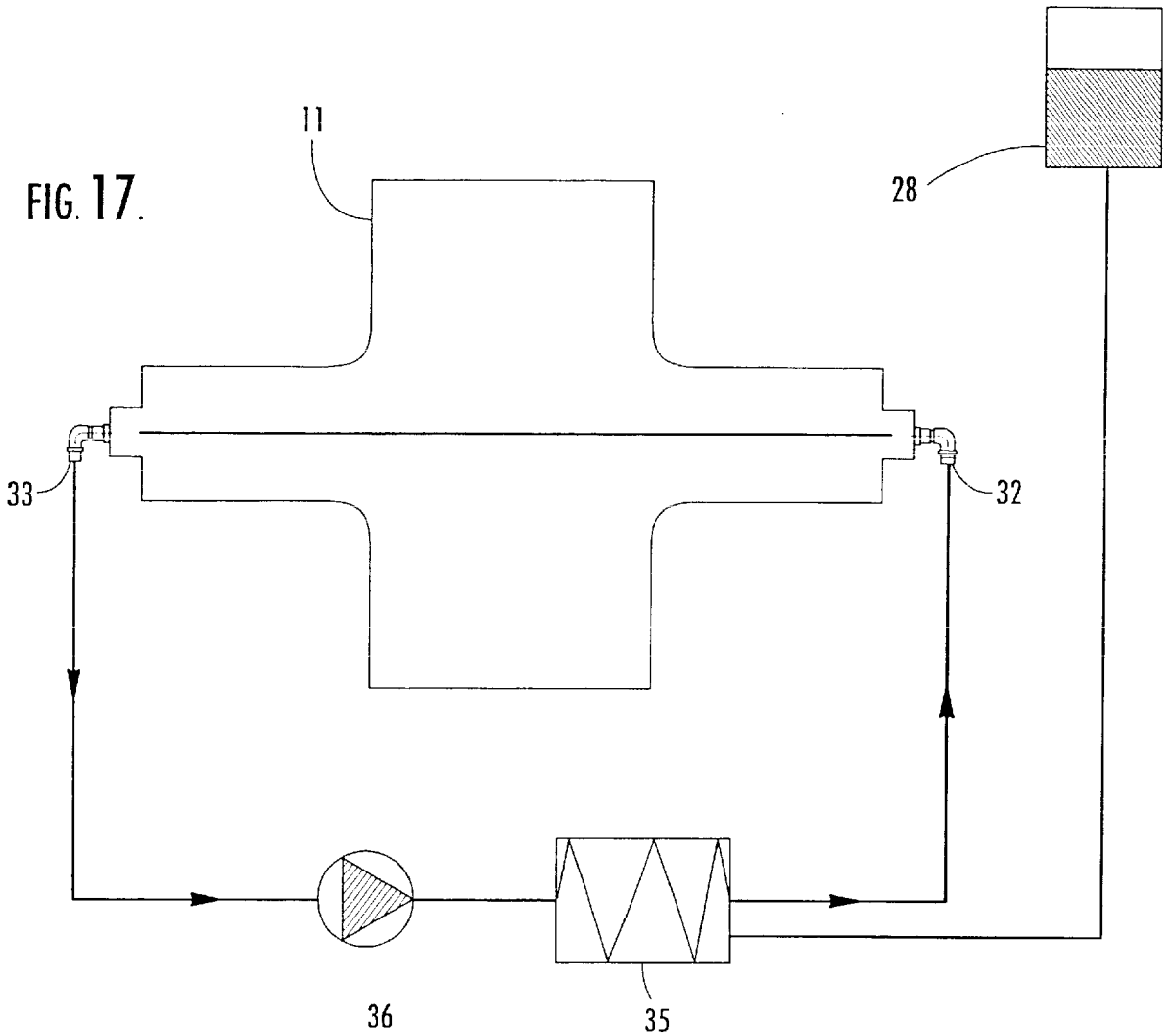
Figure 18:
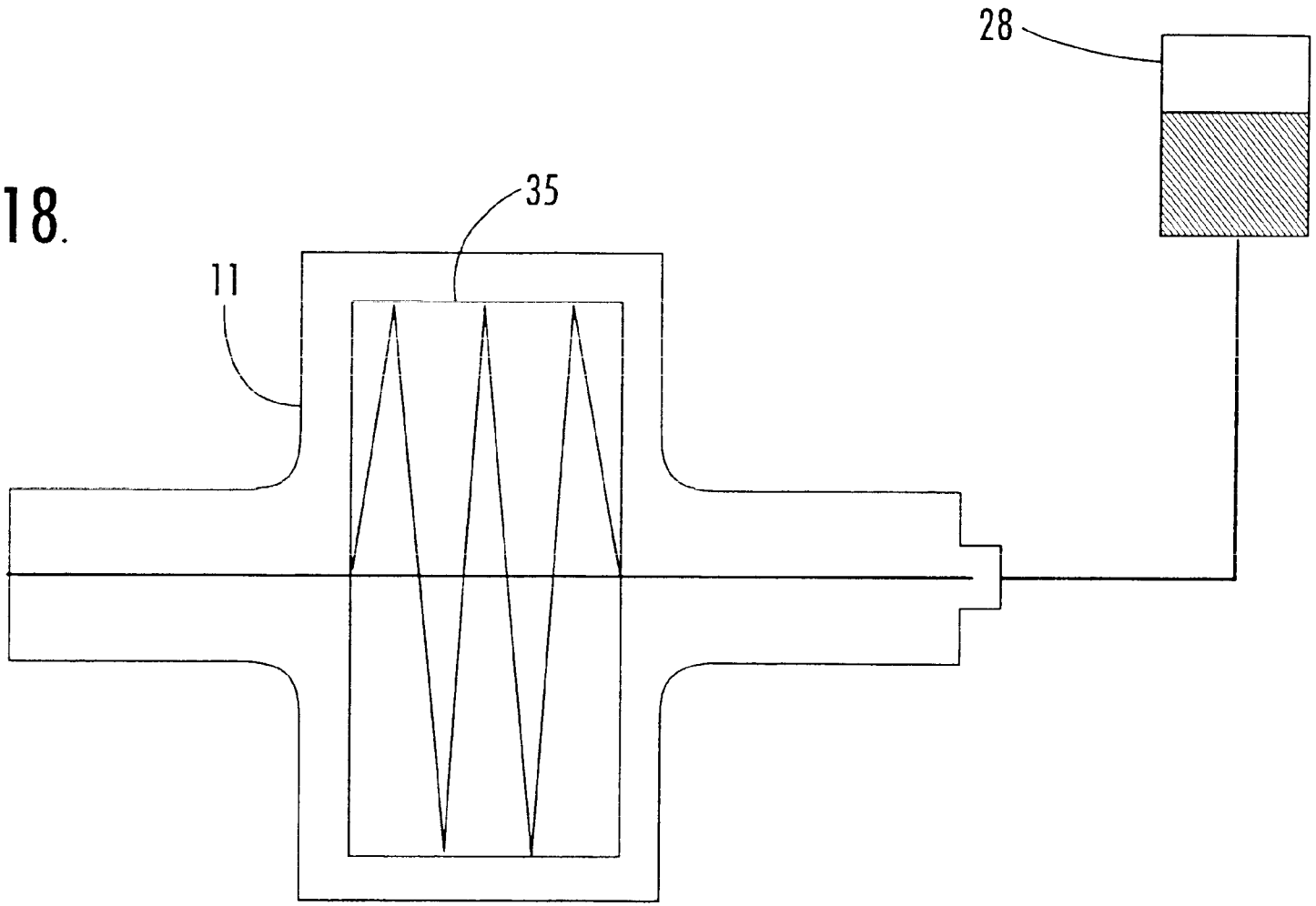
Figure 19:
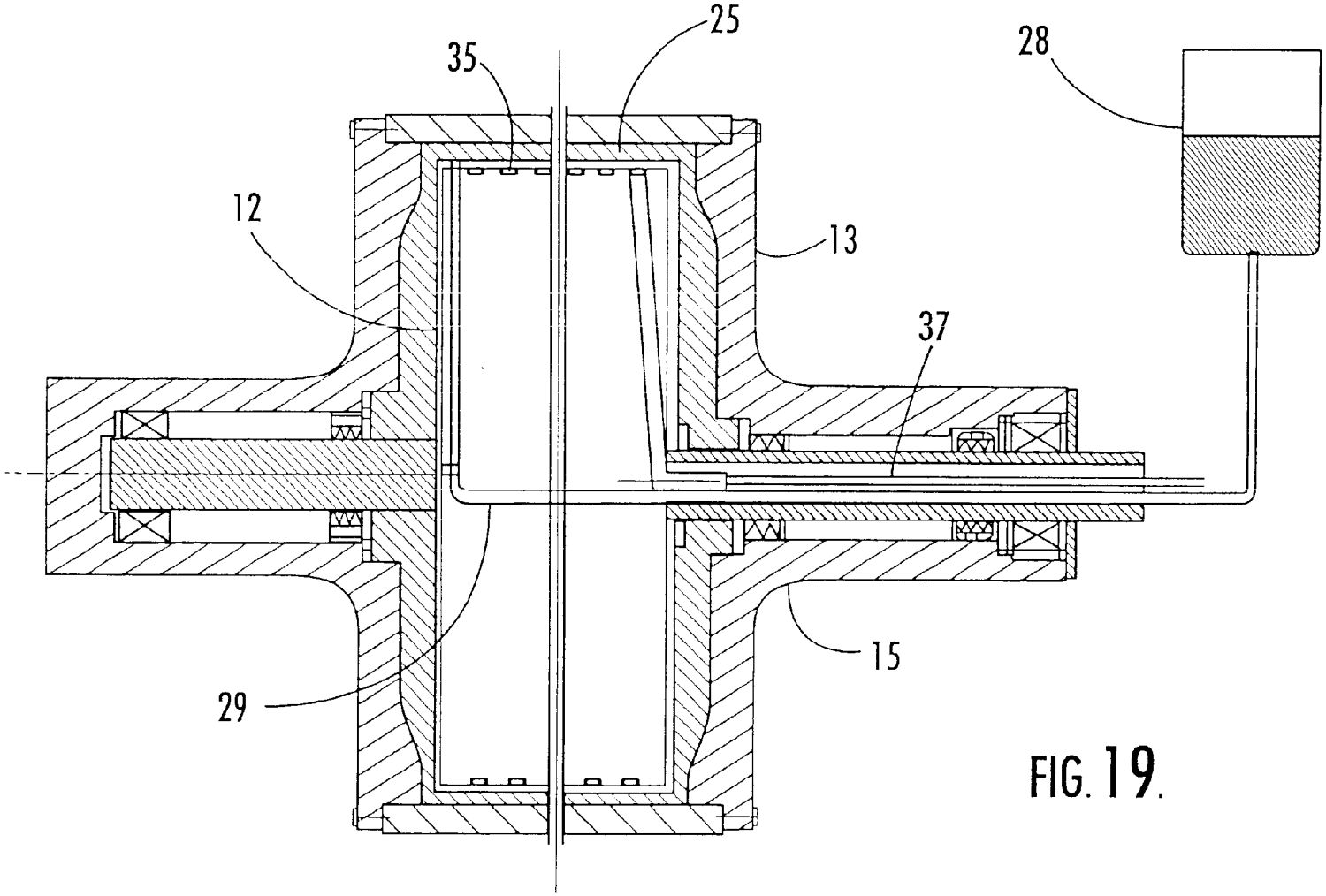

Having thus described the invention in general terms, reference will now be made to the accompanying drawings, which are not necessarily drawn to scale, and wherein:

FIG. 1 shows perspective view a of thermal roll representative of many embodiments of the present invention;

FIG. 2 shows a side elevation view of the thermal roll of FIG. 1;

FIG. 3 shows a sectional view of a thermal roll as seen from the plane denoted by line 1—1 of FIG. 2 according to one embodiment of the invention;

FIG. 4 shows a sectional view of the thermal roll of FIG. 2 as seen from the plane denoted by line 2—2;

FIG. 5 shows a sectional view of a thermal roll as seen from the plane denoted by line 1—1 of FIG. 2 and in which the heat exchange fluid enters and exits through the same head according to another embodiment of the invention;

FIG. 6 shows a sectional view of the thermal roll of FIG. 4 as seen from the plane denoted by line 3—3;

FIG. 7 shows a sectional view of a thermal roll as seen from the plane denoted by line 1—1 of FIG. 2 and in which the roll includes distributing pipes and delivering pipes according to another embodiment of the invention;

FIG. 8 shows a sectional view of the thermal roll of FIG. 6 as seen from the plane denoted by line 4—4;

FIG. 9 shows a sectional view of a thermal roll as seen from the plane denoted by line 1—1 of FIG. 2 and in which the roll includes distributing and delivering pipes and an inlet and exit located at one end of the roll according to another embodiment of the invention;

FIG. 10 shows a sectional view of the thermal roll of FIG. 8 as seen from the plane denoted by line 5—5;

FIG. 11 shows a broken sectional view of a thermal roll as seen from the plane denoted by line 1—1 of FIG. 2 and in which the roll includes connection pipes made of flexible hose according to another embodiment of the invention;

FIG. 12 shows a sectional view of the thermal roll of FIG. 10 as seen from the plane denoted by line 6—6;

FIG. 13 shows a broken sectional view of a thermal roll as seen from the plane denoted by line 1—1 of FIG. 2 and in which the roll includes connection pipes made of flexible hose and an inlet and exit located at one end of the roll according to one embodiment of the present invention;

FIG. 14 shows a sectional view of the thermal roll of FIG. 12 as seen from the plane denoted by line 7—7;

FIG. 15 shows a sectional view of a thermal roll as seen from the plane denoted by line 1—1 of FIG. 2 and in which the roll includes a main supply pipe and a hydraulically disconnected and colinear main evacuation pipe according to one embodiment of the present invention;

FIG. 16 shows a sectional view of the thermal roll of FIG. 14 as seen from the plane denoted by line 8—8;

FIG. 17 shows a flow schematic of a thermal roll with an external temperature regulating device and an expansion tank according to one embodiment of the present invention;

FIG. 18 shows a flow schematic of a thermal roll with an internal temperature regulating device according to one embodiment of the present invention; and FIG. 19 shows a broken sectional view of a thermal roll including an internal heater according to one embodiment of the present invention.

DETAILED DESCRIPTION OF THE INVENTION

The present invention now will be described more fully hereinafter with reference to the accompanying drawings, in which preferred embodiments of the invention are shown. This invention may, however, be embodied in many different forms and should not be construed as limited to the embodiments set forth herein; rather, these embodiments are provided so that this disclosure will be thorough and complete, and will fully convey the scope of the invention to those skilled in the art. Like numbers refer to like elements throughout.

Referring to FIG. 1, there is shown a thermal roll 11 and a second roll 31, which together form a roll nip. A continuous fibrous web 30 passes through the nip and is processed by one or both of the thermal roll 11 and the second roll 31. Alternatively, a shoe press roll or other supporting elements known in the art could be used in place of the second roll 31 to form the nip. A side elevation view of the arrangement of FIG. 1 is shown in FIG. 2. The thermal roll 11 as seen in FIGS. 1 and 2 is representative of many embodiments of the present invention which appear similar in these views.

A thermal roll 11 according to one embodiment of the present invention is shown in FIG. 3. The thermal roll 11 includes a rotatable outer shell 13 and a stationary inner shell 12. The rotatable outer shell 13 includes a cylindrical outer mantle 14 that extends from a first head 15 to a second head 16. Preferably, the mantle 14 is between about 50 and 150 millimeters thick. The rotatable outer shell 13 has an outer surface 38 and an inner surface 39. The first and second heads 15, 16 are rotatably supported by outer bearings 21 and the heads 15, 16 support the stationary inner shell 12 on inner bearings 26. The stationary inner shell 12 is located within the rotatable outer shell 13. The stationary inner shell 12, which can be formed of steel, is also cylindrical and has an outer surface 40 and an inner surface 41. The outer diameter of the stationary inner shell 12 is less than the inner diameter of the rotatable outer shell 13 so that an annular space 25 exists outside the stationary inner shell 12 and within the rotatable outer shell 13. The annular space 25 is defined by the inner surface 39 of the rotatable outer shell 13 and the outer surface 40 of the stationary inner shell 12. The difference between the inside diameter of the rotatable outer shell 13 and the outer diameter of the stationary inner shell 12 is typically less than 100 millimeters. In a preferred embodiment the difference in diameters is less than about 80 millimeters so that the width of the annular space 25 is less than about 40 millimeters. The annular space 25 is filled with a heat exchange fluid, such as oil or water, which exchanges heat with the fibrous web 30 through the mantle 14 of the rotatable outer shell 13. The annular space 25 is completely filled by the heat exchange fluid, and thus contains no air or other gas.

A main supply pipe 19 extends through the thermal roll 11. The main supply pipe 19 extends from outside the thermal roll 11, through the first head 15 of the rotatable outer shell 13, and into the stationary inner shell 12. Supply connection pipes 17*a* connect the main supply pipe 19 to a plurality of inner shell openings 18. Evacuation connection pipes 17*b* connect other inner shell openings 18 to a main evacuation pipe 20 which extends from within the stationary inner shell 12, through the second head 16 of the rotatable outer shell 13, and outside the thermal roll 11. In this embodiment, the main evacuation pipe 20 is colinear with the main supply pipe 19, and a section of the main evacuation pipe 20 is coincident with the main supply pipe 19. The main evacuation pipe 20 has a diameter larger than the main supply pipe 19, and the main supply pipe 19 is located within the main evacuation pipe 20 where the two pipes 19, 20 are coincident. This arrangement can be seen more clearly in FIG. 4. Although the main supply pipe 19 and the main evacuation pipe 20 are shown to have constant diameters, in other embodiments the diameters are not constant across the length of the pipes 19, 20. For example, the main supply pipe 19 and the main evacuation pipe 20 can have conical shapes that converge in the flow direction. The conical shapes can be advantageous for making the rate of flow uniform throughout the pipes 19, 20.

As shown in FIGS. 3 and 4, the direction of flow of the heat exchange fluid is the same in the main supply pipe 19 and the main evacuation pipe 20. An inlet 32 of the main supply pipe 19 is located at one end of the thermal roll 11, and an outlet 33 of the main evacuation pipe 20 is located at the opposite end of the thermal roll 11. Thus, heat exchange fluid enters the main supply pipe 19 through an inlet 32 and flows through the main supply pipe 19 within the stationary inner shell 12 and through the supply connection pipes 17*a* to the annular space 25 between the stationary inner shell 12 and the rotatable outer shell 13. From the annular space 25, the heat exchange fluid flows through the evacuation connection pipes 17*b* to the main evacuation pipe 20 and through the main evacuation pipe 20 to the outlet 33.

It can be seen in FIG. 4 that the connection pipes 17*a*, 17*b* are spaced radially and that the direction of flow of the heat exchange fluid within the connection pipes 17*a*, 17*b* alternates so that each supply connection pipe 17*a* is configured next to evacuation connection pipes 17*b*. Thus, in this embodiment, a primary route of circulation for the heat exchange fluid is to flow out of the stationary inner shell 12 through a supply connection pipe 17*a*, then through the annular space 25 to an evacuation connection pipe 17*b* and back into the stationary inner shell 12.

Neither the stationary inner shell 12 nor the pipes 17*a*, 17*b*, 19, 20 within the stationary inner shell 12 rotate with the rotatable outer shell 13. The couplings between the pipes 17*a*, 17*b*, 19, 20 are also stationary. Thus, the circulating system for the heat exchange fluid is simplified, and the risk of leaks in the couplings is reduced.

Check valves (not shown) may be incorporated at various points throughout the pipes to control the direction of flow. Additionally, a pump (not shown in FIG. 4) is used to circulate the heat exchange fluid through the thermal roll 11. The heat exchange fluid which fills the annular space 25 does not require high pressure for circulation. A lower pressure reduces wear on components such as the pipes 19, 20, 17*a*, 17*b* and also reduces the risk of danger to nearby equipment and people. In this embodiment, the internal friction in the heat exchange fluid is less than the friction that results between the heat exchange fluid and the surfaces 39, 40 of the thermal roll 11. Thus, the rotation of the rotatable outer shell 13 imparts movement in the heat exchange fluid and causes it to circulate throughout the pipes 19, 17*a*, 17*b*, 20, thus reducing the load on the pump. Also, the thermal roll 11 requires a low flow rate because of the small volume of the annular space 25. For example, the thermal roll 11 of the present invention with an outside diameter of about 2100 millimeters and a length of about 1000 millimeters requires a flow rate of heat exchange fluid of about 1000 liters per minute. Larger rolls according to the present invention require approximately proportionately higher flow rates. For example, rolls with lengths of about 3000 to 5000 millimeters require between about 3000 and 5000 liters per minute.

The heat exchange fluid that fills the annular space 25 between the stationary inner shell 12 and the rotatable outer shell 13 can also circulate to and from chambers 34 defined by the first and second heads 15, 16 of the rotatable outer shell 13 and the stationary inner shell 12. However, because the stationary inner shell 12 extends from positions proximate to the heads 15, 16, the volume of the chambers 34 is not great and the chambers 34 therefore contain little fluid. The distance between the stationary inner shell 12 and the heads 15, 16 can be as small as about 40 millimeters. Additionally, because the relative movement between the rotatable outer shell 13 and the stationary inner shell 12 occurs at the mantle 14, the fluid flows more in the annular space 25 than in the chambers 34. Fluid flow within the annular space 25 is also greater than in the chambers 34 because the inner shell openings 18 are located proximate to the mantle 14 and so the flow to and from the connection pipes 17*a*, 17*b* is directly to and from the annular space 25, not the chambers 34. Minimizing the volume of the heat exchange fluid in, and the incidental flow of the heat exchange fluid through, the chambers 34 reduces the heat transfer that occurs through the first and second heads 15, 16, thus reducing the loss of wasted heat energy through the heads 15, 16. This reduces the required re-heating of the heat exchange fluid and saves energy. The fluid disposed in the chambers 34 maintains the heads 15, 16 at a temperature similar to the temperature of the mantle 14, thus minimizing thermal stresses by differences in temperature.

The first and second heads 15, 16 are elongate in the direction of the longitudinal axis of the rotatable outer shell 13. Thus the inner bearings 26 that support the stationary inner shell 12 and the outer bearings 21 that support the rotatably outer shell 13 are not located proximate to the chambers 34. One or more seals or gaskets 24 retain the heat exchange fluid in the chambers 34 and separated from the inner bearings 26. Thus the elongate shape of the heads 15, 16 and the presence of the seals or gaskets 24 and intervening air space restrict the transfer of heat between the heat exchange fluid and the inner bearings 26. This reduces the thermal stress and wear on the inner bearings 26 and lengthens their expected operating life. The reduced heating of the bearings 26 also allows smaller diameter bearings 26 to be used, which also reduces the cost of the bearings 26.

FIGS. 5 and 6 show another embodiment of the present invention in which the inlet 32 and outlet 33 are located at the same side of the thermal roll 11. As shown, the stationary inner shell 12 is supported by a stationary bearing 26 at one head 15 and a journal bearing 27 at the opposite head 16. The journal bearing 27 allows axial movement of the stationary inner shell 12 relative to the head 16 to accommodate thermal expansion and contraction of the roll components.

The main supply pipe 19 and the main evacuation pipe 20 are colinear and coincident along their entire lengths. The main evacuation pipe 20 has a larger diameter than the main supply pipe 19, and the main supply pipe 19 is located within the main evacuation pipe 20 as shown in FIG. 6.

In another embodiment of the present invention, the connection pipes 17*a*, 17*b* are fluidly connected to the annular space 25 through a number of distributing pipes 22*a*, 22*b* and delivering pipes 23*a*, 23*b*. The heat exchange fluid from different connection pipes 17*a*, 17*b* mixes in the distributing pipes 22*a*, 22*b*. Thus, if the temperature of the heat exchange fluid varies throughout the length of the main supply pipe 19, the heat exchange fluid mixes in the supply distributing pipes 22*a* and the temperature variation throughout the pipe 22*a* is reduced.

As can be seen in FIGS. 7 and 8, all of the supply connection pipes 17*a* at each circumferential location are connected to a supply distributing pipe 22*a* which is connected to a plurality of supply delivering pipes 23*a*. Thus, the heat exchange fluid enters the main supply pipe 19 through an inlet 32 and flows through the main supply pipe 19 within the stationary inner shell 12 and through the supply connection pipes 17*a* to one of the supply distributing pipes 22*a*. The heat exchange fluid then flows through the supply delivering pipes 23*a* to the annular space 25 between the stationary inner shell 12 and the rotatable outer shell 13. From the annular space 25, the heat exchange fluid flows through the evacuation delivering pipes 23*b* to the evacuation distributing pipes 22*b* and then through the evacuation connection pipes 17*b* to the main evacuation pipe 20. The heat exchange fluid flows through the main evacuation pipe 20 to the outlet 34. In this embodiment, the inlet 33 of the main supply pipe 19 is located at one end of the thermal roll 11 and the main evacuation pipe 20 is located at the opposite end. In another embodiment, both of the inlet 32 and the outlet 33 are located at one end of the thermal roll 11 as discussed above with regard to FIGS. 5 and 6. Accordingly, FIGS. 9 and 10 show a thermal roll 11 having the inlet 32 and the outlet 33 at one side.

The distance between each of the connection pipes 17*a*, 17*b* and the delivering pipes 23*a*, 23*b* which are attached to a common distribution pipe 22*a*, 22*b* can be the same or different. For example, in the embodiment shown in FIG. 7, consecutive supply connection pipes 17*a* are separated by a distance approximately equal to the distance between consecutive supply delivering pipes 23*a*, but consecutive evacuation connection pipes 17*b* are separated by a distance approximately twice the distance between consecutive evacuation delivering pipes 23*b*. Preferably, the total area of all of the supply delivering pipes 23*a* where the supply delivering pipes 23*a* connect to the annular space 25 is equal to the total area of all the evacuation delivering pipes 23*b* where the evacuation delivering pipes 23*b* connect to the annular space 25. Also, there can be a different number of delivering pipes 23*a*, 23*b* and connection pipes 17*a*, 17*b*, as shown in FIG. 7 where there are more delivering pipes 23*a*, 23*b* than connection pipes 17*a*, 17*b*. The higher number of inner shell openings 18, due to the delivering pipes 23*a*, 23*b*, promotes an even more consistent temperature profile in the cross-machine direction.

The delivering pipes 23*a*, 23*b* can have a cylindrical shape, as shown in FIGS. 7 and 9, or they can have a conical shape that converges in the flow direction. The conical shape can be advantageous for regulating the rate of flow to achieve uniform flow rates within the delivering pipes 23*a*, 23*b*.

The connection pipes 17*a*, 17*b*, the distributing pipes 22*a*, 22*b*, and the delivering pipes 23*a*, 23*b* may be formed of rigid materials such as steel, stainless steel, other metals, polymers, and the like. Alternatively, the pipes 17*a*, 17*b*, 22*a*, 22*b*, 23*a*, 23*b* may be formed of soft or flexible materials such as flexible steel hose. The pipes preferably can withstand temperatures of 550° C. FIGS. 11 and 12 show a thermal roll 11 with flexible connection pipes 17*a*, 17*b*. The flexible connection pipes 17*a*, 17*b* can be configured so that so that heat exchange fluid is directed from a single longitudinal location of the main supply pipe 19 to inner shell openings 18 that are located at different longitudinal positions along the length of the stationary inner shell 12. This configuration can be used to maintain a uniform temperature of the heat exchange fluid within the annular space 25, even if there is a temperature variation of the heat exchange fluid in the main supply pipe 19.

Another advantageous feature is that all the supply connection pipes 17*a* are connected to the main supply pipe 19 at a common longitudinal location. Similarly, all of the evacuation connection pipes 17*b* are connected to the main evacuation pipe 20 at a common longitudinal location. Thus, the heat exchange fluid enters the main supply pipe 19 at the inlet 32 and flows into the stationary inner shell 12. All of the heat exchange fluid flows out of the main supply pipe 19 at a common longitudinal location and into the supply connection pipes 17*a* which connect to the annular space 25 at multiple longitudinal locations. The heat exchange fluid exits the annular space 25 at different multiple longitudinal locations and flows through the evacuation connection pipes 17*b* to a common longitudinal location on the main evacuation pipe 20. The heat exchange fluid then flows through the main evacuation pipe 20 to the outlet 33. The main supply pipe 19 and the main evacuation pipe 20 are colinear. In the embodiment of FIGS. 13 and 14, both the inlet 32 and the outlet 33 are located at the same end of the thermal roll 11.

In the embodiment of FIGS. 15 and 16, the thermal roll 11 comprises distributing pipes 22*a*, 22*b* and delivery pipes 23*a*, 23*b*, and all of the supply connection pipes 17*a* are connected to the main supply pipe 19 at a common longitudinal location. Additionally, each of the supply distributing pipes 22*a* is connected to exclusively one of the supply connection pipes 17*a*. Thus, all of the heat exchange fluid exits the main supply pipe 19 at a common longitudinal location, and all of the heat exchange fluid enters the supply 22*a* at a common longitudinal location. Similarly, the evacuation connection pipes 17*b* are connected to the main evacuation pipe 20 at a common longitudinal location, and each of the evacuation distributing pipes 22*b* is connected exclusively to one of the evacuation connection pipes 17*b*.

The heat exchange fluid is either heated or cooled depending on the type of processing that is performed on the fibrous web 30. For impulse drying, the temperature of the heat exchange fluid is typically about 300° C. or higher. A temperature regulating device 35 is used to heat or cool the heat exchange fluid. The temperature regulating device 35 can be a heater, such as an electric heater, a gas heater, or heat exchanger. A variety of other heating devices and cooling devices are well known in the prior art.

The temperature regulating device 35 can be located within the thermal roll 11, for example within the stationary inner shell 12, or it can be located outside the thermal roll 11. A schematic of a thermal roll 11 according to one embodiment of the present invention is shown in FIG. 17. In this embodiment, the heat exchange fluid is pumped by a pump 36 through the temperature regulating device 35 where it is heated. The fluid then flows in the inlet 32 of the main supply pipe 19 and circulates in the thermal roll 11. The heat exchange fluid exits the thermal roll through the outlet 33 and flows back to the pump 36. The heat exchange fluid is then recirculated to the temperature regulating device 35 where the temperature of the heat exchange fluid is adjusted as necessary.

An expansion tank 28 is fluidly connected to the thermal roll 11. The expansion tank 28 contains a quantity of heat exchange fluid and a quantity of compressed gas. The flow of the heat exchange fluid in the thermal roll 11 is controlled by adjusting the pressure of the gas in the expansion tank 28. Thus, the expansion tank 28 can be used to effect flow changes or maintain a constant flow. Flow changes are sometimes required during operation. For example, a flow increase is required when the speed of the rotatable outer shell 13 is increasing. In the embodiment shown in FIG. 17, the expansion tank 28 is connected to the temperature regulating device 35, but it may be connected instead to others parts of the thermal roll 11. The expansion tank 28 has a sufficient volume of compressed gas so that if the volume of heat exchange fluid changes, due to thermal expansion for example, a corresponding volume of heat exchange fluid flows from within the rotatable outer shell 13 to the expansion tank 28. Thus, a nearly uniform flow is maintained in the thermal roll 11.

FIG. 18 shows a schematic of a thermal roll 11 with an internal temperature regulating device 35. In this embodiment, the heat exchange fluid does not circulate outside the thermal roll 11 to be heated but is instead heated within the roll 11. The temperature regulating device 35 is located within the stationary inner shell 12, and may be a heating device of any of the types described above or known in the art. For example, the temperature regulating device may comprise an electric induction or resistance heater that is located within the stationary inner shell 12 proximate to the annular space 25 as shown in FIG. 19. As shown in FIG. 19, electricity is provided to the temperature regulating device 35 by electric cables 37 routed through one of the heads 15, 16 of the rotatable outer shell 13. Alternatively, the electric cables 37 may be routed through both of the heads 15, 16 of the rotatable outer shell 13.

Because the temperature regulating device 35 is located within the thermal roll 11 in the embodiment shown in FIG. 19, the heat exchange fluid is not circulated outside the thermal roll 11 for temperature regulation. In this embodiment, there is circulation of heat exchange fluid outside the thermal roll 11 during normal operation except for heat exchange fluid that flows through an expansion tank connection pipe 29 that connects the expansion tank 28 to the annular space 25. The expansion tank 28 and the expansion tank connection pipe 29 allow the flow to be adjusted as described above. For example, if the heat exchange fluid expands when it is heated, heat exchange fluid will flow through the expansion tank connection pipe 29 and into the expansion tank 28, thus maintaining a uniform flow in the annular space 25.

Many modifications and other embodiments of the invention will come to mind to one skilled in the art to which this invention pertains having the benefit of the teachings presented in the foregoing descriptions and the associated drawings. Therefore, it is to be understood that the invention is not to be limited to the specific embodiments disclosed and that modifications and other embodiments are intended to be included within the scope of the appended claims. Although specific terms are employed herein, they are used in a generic and descriptive sense only and not for purposes of limitation.

That which is claimed:

1. A thermal roll for use in a paper machine and being capable of containing an internal heat exchange fluid, the roll comprising:

a rotatable outer shell having an outer surface and an inner surface, the rotatable outer shell extending from a first head to a second head, wherein the rotatable outer shell is positioned for rotation about a longitudinal axis;

a stationary inner shell positioned within the rotatable outer shell, the stationary inner shell having an outer surface and an inner surface wherein the inner surface of the rotatable outer shell and the outer surface of the stationary inner shell define an annular space, and the stationary inner shell extending from a first end to a second end and defining a plurality of inner shell openings;

a main supply pipe positioned within the stationary inner shell and extending from the first end of the stationary inner shell longitudinally in a direction toward the second end of the stationary inner shell for supplying heat exchange fluid; and a plurality of connection pipes, the connection pipes connecting the main supply pipe to the plurality of inner shell openings so that the heat exchange fluid is supplied to the annular space such that the annular space is completely filled with the heat exchange fluid and heat is effectively exchanged by the roll through the rotatable outer shell.

2. The thermal roll of claim 1 wherein the main supply pipe is conical in shape.

3. The thermal roll of claim 1 wherein the main supply pipe extends from the first head of the rotatable outer shell longitudinally to the second head of the rotatable outer shell, the main supply pipe has an inlet located at one of the first or second heads of the rotatable outer shell, and the main supply pipe has an outlet located at the other of the first or second heads of the rotatable outer shell.

4. The thermal roll of claim 1 wherein the main supply pipe has an inlet and an outlet and wherein both the inlet and the outlet of the main supply pipe are located at the same one of either the first or second heads of the rotatable outer shell.

5. The thermal roll of claim 1 wherein the main supply pipe is directly connected to each of the connection pipes.

6. The thermal roll of claim 1 wherein the annular space encompasses a perimeter of the outer surface of the inner shell.

7. The thermal roll of claim 1 wherein the inner surface of the outer shell is located less than 40 millimeters from the outer surface of the inner shell.

8. The thermal roll of claim 1 wherein the annular space extends from the first head of the rotatable outer shell to the second head of the rotatable outer shell.

9. The thermal roll of claim 1 wherein the connection pipes comprise flexible hose.

10. The thermal roll of claim 1 wherein the stationary inner shell defines an inner body space encompassing the connection pipes.

11. The thermal roll of claim 1 further comprising a main evacuation pipe, the main evacuation pipe positioned within the stationary inner shell and extending from the first end of the stationary inner shell longitudinally in a direction toward the second end of the stationary inner shell.

12. The thermal roll of claim 11 wherein the main evacuation pipe is conical in shape.

13. The thermal roll of claim 11 further comprising a plurality of evacuation connection pipes, and the inner shell further comprising a second plurality of inner shell openings, the evacuation connection pipes connecting the main evacuation pipe to the second plurality of inner shell openings.

14. The thermal roll of claim 1 wherein the first end of the stationary inner shell and the first head of the rotatable outer shell define a first end space and the second end of the stationary inner shell and the second head of the rotatable outer shell define a second end space, the first and second end spaces connected to the annular space.

15. The thermal roll of claim 1 further comprising an expansion tank fluidly connected to the annular space and containing quantities of both the heat exchange fluid and a compressed gas.

16. The thermal roll of claim 1 further comprising a temperature regulating device for changing the temperature of the heat exchange fluid.

17. The thermal roll of claim 1 further comprising a pump for assisting the supply of the heat exchange fluid to the annular space.

18. A thermal roll for use in a paper machine and being capable of containing an internal heat exchange fluid, the roll comprising:

a rotatable outer shell having an outer surface and an inner surface, the rotatable outer shell extending from a first head to a second head, wherein the rotatable outer shell is positioned for rotation about a longitudinal axis;

a heating device located within the space defined by the rotatable outer shell for heating the heat exchange fluid; and a stationary inner shell positioned within the outer shell, the stationary inner shell extending from a first end to a second end, the stationary inner shell having an outer surface and an inner surface, and the inner surface of the rotatable outer shell and the outer surface of the stationary inner shell defining an annular space, wherein the annular space is substantially filled with the heat exchange fluid and heat is effectively exchanged by the roll through the rotatable outer shell.

19. The thermal roll of claim 18 further comprising an expansion tank fluidly connected to the annular space and containing both the heat exchange fluid and a compressed gas.

20. The thermal roll of claim 18 wherein the heating device is located within the space defined by the stationary inner shell.

21. The thermal roll of claim 18 wherein the heating device is an electric heater.

22. A closed circulation system for thermally treating a web during papermaking comprising;

a temperature regulating device for regulating a temperature of a heat exchange fluid;

a main supply pipe fluidly connected to the temperature regulating device;

a main evacuation pipe fluidly connected to the temperature regulating device;

an annular space defined by an inner surface of a rotatable outer shell and an outer surface of a stationary inner shell, wherein the annular space is fluidly connected to the main supply pipe and the main evacuation pipe via a plurality of connection pipes and rotation of the rotatable outer shell causes the heat exchange fluid to circulate between the annular space and the temperature regulating device; and an expansion tank located outside the rotatable outer shell, wherein the expansion tank is fluidly connected to the annular space and capable of adjusting a flow of the heat exchange fluid within the circulation system.

23. The circulation system of claim 22 wherein frictional forces between the heat exchange fluid and each of the inner surface of the rotatable outer shell and the outer surface of the stationary inner shell are each greater than an internal frictional force in the heat exchange fluid such that rotation of the rotatable outer shell causes the heat exchange fluid to circulate from the annular space to the temperature regulating device.

24. The circulation system of claim 22 wherein the main supply pipe is conical in shape.

25. The circulation system of claim 22 wherein the main supply pipe extends from a first head of the rotatable outer shell longitudinally to a second head of the rotatable outer shell, the main supply pipe has an inlet located at the first head of the rotatable outer shell, and the main supply pipe has an outlet located at the second head of the rotatable outer shell.

26. The circulation system of claim 22 wherein the main supply pipe has an inlet and an outlet and wherein both the inlet and the outlet of the main supply pipe are located at the same one of either a first head of the rotatable shell or a second head of the rotatable outer shell.

27. The circulation system of claim 22 wherein the inner surface of the rotatable outer shell is located less than 40 millimeters from the outer surface of the stationary inner shell.

28. The circulation system of claim 22 wherein the connection pipes comprise flexible hose.

29. The circulation system of claim 22 wherein the main evacuation pipe is fluidly connected to the annular space, positioned within the stationary inner shell, and extends from a first end of the stationary inner shell longitudinally in a direction toward a second end of the stationary inner shell.

30. The circulation system of claim 29 wherein the main evacuation pipe is conical in shape.

31. The circulation system of claim 22 further comprising a pump for assisting the circulation of the heat exchange fluid.

32. A method of controlling a temperature of a roll for processing a web comprising:

providing a rotatable outer shell and a stationary inner shell located within the rotatable outer shell to define an annular space between an inner surface of the rotatable outer shell and an outer surface of the stationary inner shell;

completely filling the annular space with a heat exchange fluid;

rotating the rotatable outer shell relative to the stationary inner shell to provide circulation of the heat exchange fluid from a main supply pipe through a plurality of connection pipes to the annular space;

evacuating the heat exchange fluid from the annular space to a temperature regulation device;

adjusting the temperature of the heat exchange fluid in the temperature regulation device; and re-circulating the heat exchange fluid to the annular space.

33. The method of claim 32 further comprising transferring a quantity of the heat exchange fluid between the annular space and an expansion tank, wherein the expansion tank is located outside the rotatable outer shell and capable of containing quantities of both the heat exchange fluid and a compressed gas.

34. The method of claim 32 wherein said evacuating step comprises evacuating the heat exchange fluid from the annular space through an outlet located at a first end of the rotatable outer shell and wherein said re-circulating step comprises re-circulating the heat exchange fluid to the annular space through an inlet located at a second end of the rotatable outer shell opposite to the first end.

35. The method of claim 32 wherein said evacuating step comprises evacuating the heat exchange fluid from the annular space through an outlet located at a first end of the rotatable outer shell and wherein said re-circulating step comprises re-circulating the heat exchange fluid to the annular space through an inlet located at the first end of the rotatable outer shell.

36. The method of claim 32 wherein said evacuating step comprises evacuating the heat exchange fluid from the annular space through a main evacuation pipe extending from a first end of the stationary inner shell longitudinally in a direction toward a second end of the stationary inner shell.

37. The method of claim 32 wherein said evacuating step comprises evacuating the heat exchange fluid from the annular space through a plurality of evacuation connection pipes connecting the annular space to the main evacuation pipe.

* * * * *